US006817272B2

(12) United States Patent
Holland

(10) Patent No.: US 6,817,272 B2
(45) Date of Patent: Nov. 16, 2004

(54) F-TYPE CONNECTOR INSTALLATION AND REMOVAL TOOL

(75) Inventor: Michael Holland, Santa Barbara, CA (US)

(73) Assignee: Holland Electronics, Ventura, CA (US)

( * ) Notice: Subject to any disclaimer, the term of this patent is extended or adjusted under 35 U.S.C. 154(b) by 0 days.

(21) Appl. No.: 10/290,688

(22) Filed: Nov. 7, 2002

(65) Prior Publication Data

US 2004/0092165 A1 May 13, 2004

(51) Int. Cl.[7] ..... B25B 13/00
(52) U.S. Cl. ..... 81/124.2; 439/304
(58) Field of Search ..... 81/119, 121.1, 81/124.2, 176.1, 176.15, 176.2, 186; 439/304, 306, 307

(56) References Cited

U.S. PATENT DOCUMENTS 3,953,097 A * 4/1976 Graham ..... 439/307
4,730,385 A * 3/1988 Ryan et al. ..... 29/750
4,823,650 A * 4/1989 Tuttle ..... 81/124.2
5,031,981 A * 7/1991 Peterson ..... 385/56
5,564,938 A * 10/1996 Shenkal et al. ..... 439/301
6,415,499 B1 * 7/2002 Holland et al. ..... 29/564.4
6,474,201 B1 * 11/2002 Lund ..... 81/124.2

* cited by examiner

*Primary Examiner*—Thanh-Tam Le
(74) *Attorney, Agent, or Firm*—Michael G. Petit

(57) ABSTRACT

A tool operable for connecting a mail F-type coaxial cable connector having a connector ring rotatably mounted on a leading end thereof. The connector ring having a shaped outer surface. The tool includes a wrench portion and a grasping portion. The wrench portion includes a rigid, substantially tubular member having a leading end and a trailing end. An inner surface of the tubular member adjacent the leading end is dimensioned to matingly engage a portion of the shaped outer surface of the connector ring. The grasping portion having an annular leading end with a first outer diameter rigidly affixed to the trailing end of the wrench portion and an expanded annular trailing end having a second outer diameter that is greater than the first outer diameter.

5 Claims, 5 Drawing Sheets

F-TYPE CONNECTOR INSTALLATION AND REMOVAL TOOL

BACKGROUND OF THE INVENTION

1. Field of the Invention

The present invention relates to a tool for attaching a male F-type coaxial cable connector to a female F-type coaxial cable connector.

2. Prior Art

Screw-on F-type connectors are used on most RF coaxial cables to interconnect TV's, Cable TV decoders, VCR/DVD's, hard disk digital recorders, satellite receivers, video games, TV signal distribution splitters and switches. Initially, F cables (an RG-6 or RG-59 type coaxial cable with an F-type male connector at each end) were used in simple installations to interconnect a TV to a cable box, VCR or video game, with ample room between the devices to interconnect the cables by hand. The space behind such devices permitted a large bend radius for the cable between or behind the devices. An RG-6 cable, with an O.D. of 0.27 inches requires a minimum bend radius of 3 inches as specified by manufactures.

Due to space limitations imposed by the increased number of TV devices that are now interconnected in one small, high-density space or console, it has become difficult to install and remove the interconnecting F cables without first removing the device from the congested area or console. Many of these devices, such as large screen TV sets, are now positioned as close to a wall as possible forcing the F cables to make sharp bends in order to interconnect the cable to an adjacent device. As artisans skilled in the art of cable installation will appreciate, it is both the sharp bends formed in the semirigid coaxial F cables and the high density of these cables in current installations that have made the present means for installing, un-installing, tightening and loosening F-type connectors difficult and time consuming. It is the intention of this invention to provide a novel solution to this new density problem.

F connectors have a standardized design, using a 7/16 inch hex nut as the rotational connecting ring. The nut has a relatively short 1/8 to 1/4 inch length available for finger contact. The internal threads on the nut and matching F female are a 3/8-32 thread, requiring the male connector to be positioned exactly in-line with the female connector for successful thread engagement as rotation begins. When the cable extends rearwardly from the connector and is both in-line with the threaded outer surface of the female connector and straight for some distance, aligning the male connector in the proper plane is not difficult. However, when the cable is bent adjacent to the male F-type connector, as is the case where the rear-mounted F connector on the device is adjacent a wall or cabinet surface, the installer must first straighten the cable for some distance so that the F male on that cable can easily screw onto the female.

The F male connector in accordance with the prior art is designed to be screwed onto and off of the F female connector using the fingers. The hex shaped nut is provided for wrench tightening the connector after the male F connector is fully screwed onto the female F connector by the fingers (usually 4 turns). To maintain a tight electrical connection and to meet the intended electrical performance, manufacturers and industry standards require the F connector to be tightened beyond the torque achievable by using only the fingers. In the case of cable TV products, the standard has been to tighten the connector to a 25 in-lb torque or another 90–120 degrees from the finger tight position. Consumer products which have weaker female mounting structures (usually plastic) require their F connectors to be wrench-tightened just slightly beyond finger tight. When the cable is bent, the torque required to install or remove a male F connector is increased. There is a need for a tool operable for providing the additional torque required for the installation or removal of the male F connector when the attached cable is in a bent position.

There are currently two tools and methods for using the tools for tightening and loosening F connectors. A first tool is a standard open-end 7/16 inch crescent wrench with a minimum shaft length of 4–6 inches. The use of this tool requires an unobstructed area for radial rotation of the tool around the axis of the F-type connectors once the threads on both male and female have been engaged. Sufficient radial open space is rarely available on TV devices where many other connectors and cables project from a device and occupy a small area.

The second tool, originally designed to install F cables through security devices in a cable system, are currently used to install F cables in dense locations. This tool consists of a 7/16 inch hex nut driver socket with a slot on the side to allow the socket to slide over an installed cable. The disadvantage of this tool is that the cable must he in a straight line with the male and female connectors being mated. This condition is no longer the typical installation situation; making this tool ineffective for its intended use. There is a need for a tool that can be used to connect and disconnect male F connectors in high cable density applications.

Zamanzadeh, in U.S. Pat. No. 5,992,010, discloses a coaxial cable connector tool that includes a hollow elongated housing comprised of two halves hinged together. The halves are closed around a female coaxial cable connector. When the halves are closed, a hexagonal hole is formed at one end, and another hole is formed at the opposite end. The hexagonal sleeve on the connector is snugly positioned in the hexagonal hole, and the cable is positioned through the opposite hole. The sleeve is then rotated by turning the housing by hand. The housing is substantially wider than the sleeve on the connector, and includes a hexagonal outer surface, so that it may be easily gripped and turned by hand. In a second embodiment, the housing is provided as a built-in component on new connectors.

As mentioned earlier, when an F cable is bent, the torque required to loosen the connector nut increases five fold, making it almost impossible to unscrew with the fingers without the benefit of a mechanical advantage. Notwithstanding the recognition of the problem in the prior art and the tools devised to solve the problem, a commonly practiced method for cable installation is to remove the TV or similar device from the console cabinet or move it away from a wall, thereby allowing the cable to straighten; making the connection with the fingers, with or without a tool, and then returning the device into the confined space.

Modern TV-related product interconnections are now made in tight spaces such as home master distribution boxes, inside home entertainment consoles, behind TV/VCR stands, etc. where most, if not all, of the coaxial cables are bent immediately from the plane of attachment to the device in order to most efficiently reach the device connected thereto. Accordingly, there is a current need for a tool for connecting and disconnecting male F-type connectors that is operable in confined spaces and provides the desired torque under conditions wherein the cable is bent adjacent to the connector.

SUMMARY

It is an object of the present invention to provide a tool for attaching an F-type male connector having a coaxial cable attached thereto to a female F-type connector affixed to a device wherein the space between the female F-type connector and nearby structures requires that the cable be bent.

It is a further object of the invention to provide a tool meeting the above objective and operable for applying a more secure attachment of the male connector to the female connector than can be achieved using only the fingers.

1. The above objectives are met by a tool operable for connecting a male F-type coaxial cable connector having a connector ring rotatably mounted on a leading end thereof and a coaxial cable extending rearwardly from a trailing end thereof, to a female F-type connector mounted on a device, the connector ring having a threaded inner surface and a shaped outer surface. The tool includes a wrench portion and a grasping portion affixed to, and integral with, the wrench portion. The wrench portion includes a rigid, substantially tubular member having a leading end, a trailing end and a hollow body portion therebetween. An inner surface of the tubular body portion adjacent the leading end is dimensioned to matingly engage a portion of the shaped outer surface of the connector ring. The body portion has a slot therein extending from the leading end to the trailing end thereof. The grasping portion is a hollow member having an annular leading end with a first outer diameter rigidly affixed to the trailing end of the wrench portion and an expanded annular trailing end having a second outer diameter that is greater than the first outer diameter. The trailing end of the grasping portion is spaced from the leading end of the grasping portion by a rigid spacer. The leading end and preferably the trailing end of the grasping portion are slotted. In a first preferred embodiment, the rigid spacer comprises a slotted funnel. In another embodiment, the rigid spacer comprises an elongate strut. In yet a further embodiment of the tool, the rigid spacer comprises a hollow tubular member having a wall, a length and a slot in the wall coextensive with the length. In another embodiment, the trailing end of the grasping portion comprises an annular ring that preferably has a slot therein dimensioned to pass a cable through the ring circumference. The tool is particularly useful for attaching (or detaching) the male connector to the female connector when the coaxial cable is bent.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

Figure 1:
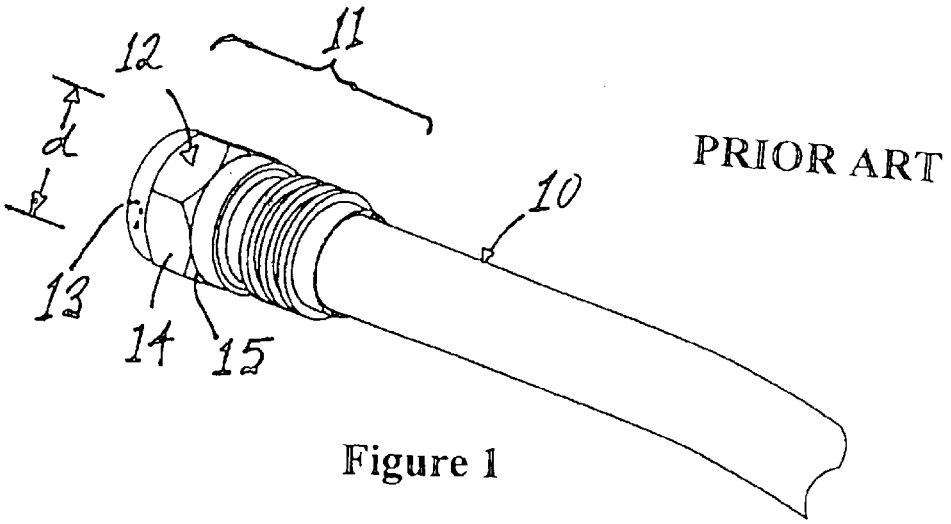
PRIOR ART Figure 1
FIG. 1 is a perspective view of an F cable having a male F-type coaxial cable connector attached thereto.

FIG. 1 is a perspective view of an F cable 10 having a male F-type coaxial cable connector 11 attached thereto. The male F-type coaxial cable connector 11 has a connector ring 12 rotatably mounted thereon. The inner surface 13 of the connector ring 12 is threaded and the outer surface 14 is shaped to permit rotatably locking, engagement between the connector ring 12 and a tool (not shown) such as a hexagonal, open-end wrench. The trailing end 15 of the connector ring 12 includes a stepped shoulder. In FIG. 1, the cable 10 is shown as straight, extending rearwardly from the connector 11. In practical installations, the cable 10 is bent adjacent the connector 11, rendering operation of prior art tightening wrenches difficult.

Figure 2:
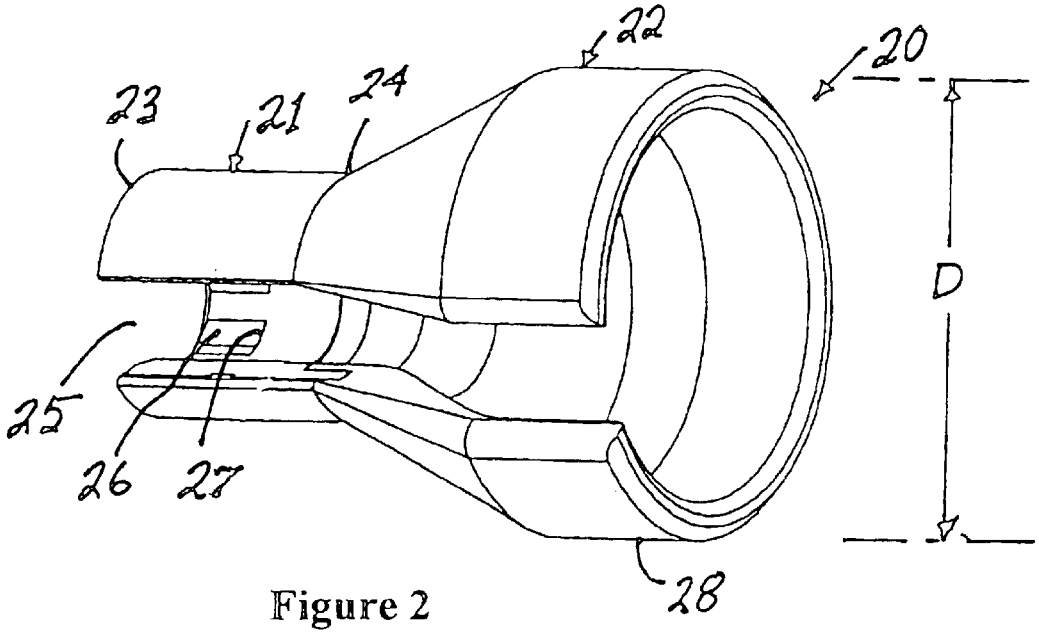
FIG. 2 is a perspective view of a coaxial cable connector tool in accordance with a first preferred embodiment of the present invention.

Turning now to FIG. 2, a first preferred embodiment of a coaxial cable installing tool 20 is illustrated in perspective view. The tool 20 is of integral construction and comprises a wrench portion 21 and a grasping portion 22. The wrench portion 21 is a hollow, rigid, substantially cylindrical member having a leading end 23, a trailing end 24 and a slot 25 in the wall thereof coextensive with the axial length of the wrench portion 21. The inner surface of the wrench portion 21 has a shaped portion 26 dimensioned to matingly engage the shaped outer surface 14 of the connector ring 12 on the connector 11. A stepped stop 27 on the inner surface of the wrench portion prevents the wrench portion from sliding past the connector ring 12 when the tool 20 is advanced over the cable 10 in the direction of the connector 11.

Figure 3:
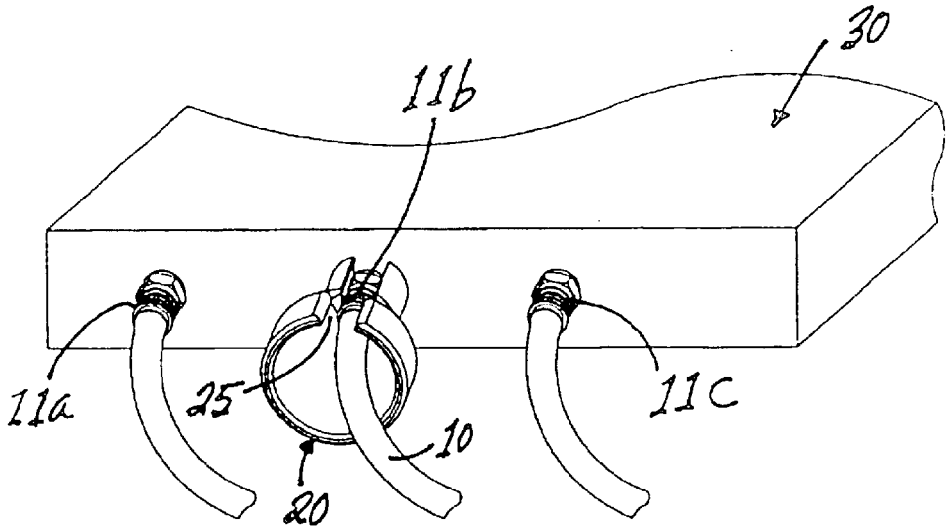
FIG. 3 is a perspective view of a device having a plurality of female F-type connectors affixed thereto illustrating the first preferred embodiment of the tool shown in FIG. 2 being employed to attach (or detach) a male F-type connector to a female F-type connector mounted on the device.

The operation of the tool 20 can best be understood by reference to FIG. 3. FIG. 3 is a perspective view of a device 30 having a plurality of female F-type connectors thereon with a plurality of male connectors 11*a*, 11*b* and 11*c* affixed thereto, illustrating the first preferred embodiment of the tool 20 shown in FIG. 2 being employed to attach (or detach) a male F-type connector 11 to a female F-type connector mounted on the device. The portion of the cable 10 adjacent the male F-type connectors 11*a*–11*c* is bent as is the case in most situations. The bent cable exerts a lateral force on the male connector that substantially increases the torque required to turn the connector ring. The cable is inserted through the slot 25 of the tool and the tool 20 is advanced along the the length of the cable until the stepped stop 27 on the inner surface of the wrench portion engages the stepped shoulder 15 on the connector ring. When the tool is thus disposed with respect to the connector, the shaped inner surface of the tool engages the shaped outer surface of the connector ring. The trailing end 24 of the grasping portion 20 is gripped by the fingers and the tool is twisted clockwise to engage the connectors or counterclockwise to disengage. The outer diameter D of the grasping portion is much greater than the outer diameter d of the connector ring, thereby providing the mechanical advantage required to apply the necessary torque to the connector ring 12 to attach it to a mating connector.

Figure 4:
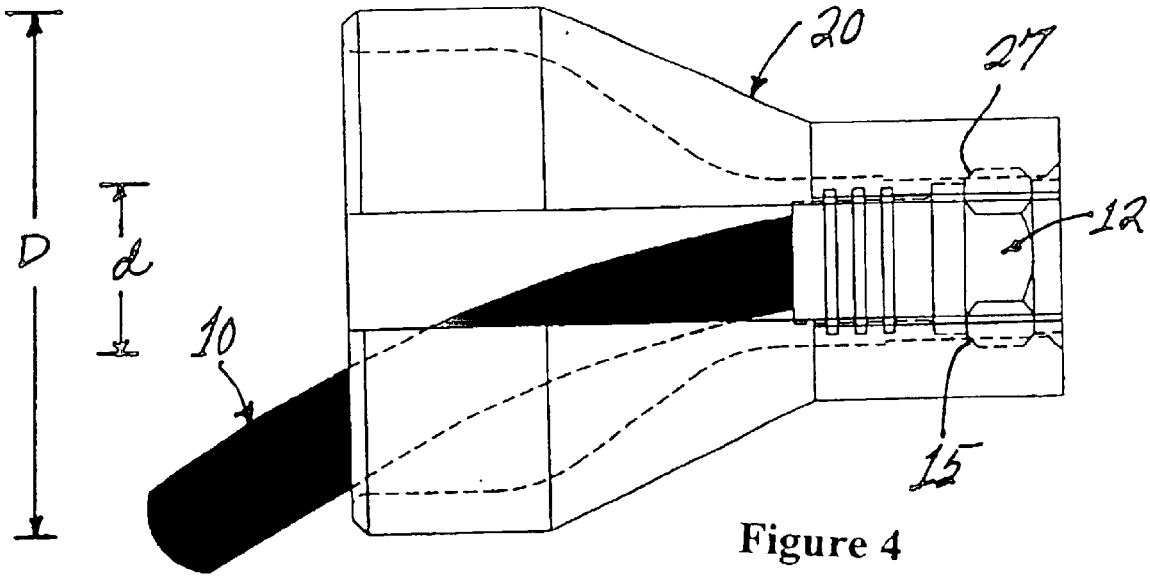
FIG. 4 is a lateral partially cross-sectional view of the first preferred embodiment of the tool of FIG. 2 positioned over a male F-type connector in preparation for installing the cable.

FIG. 4 is a lateral view of the first preferred embodiment of the tool of FIG. 2 positioned over a male F-type connector in preparation for installing the cable on a mating female connector. The inner surface of the wrench portion 21 and grasping portion 22 is shown in phantom. It is an important feature of all of the embodiments of the tool of the present invention that the cable 10 does not interfere with or otherwise obstruct rotation of the tool during attachment or detachment of the connector. While a prior art open-end wrench or similar tool can be used for the initial loosening or the final tightening of the connector ring, the obstruction presented by the plurality of cables interferes with the continuous turning of the ring. It is a common feature of all embodiments of the tool of the present invention that the tool not only enables the cable installer to continuously rotate the connector ring during installation/removal, even in the presence of other nearby cables, but also provides sufficient mechanical advantage to tighten and loosen a connector when the cable adjacent thereto is bent.

Figure 5:
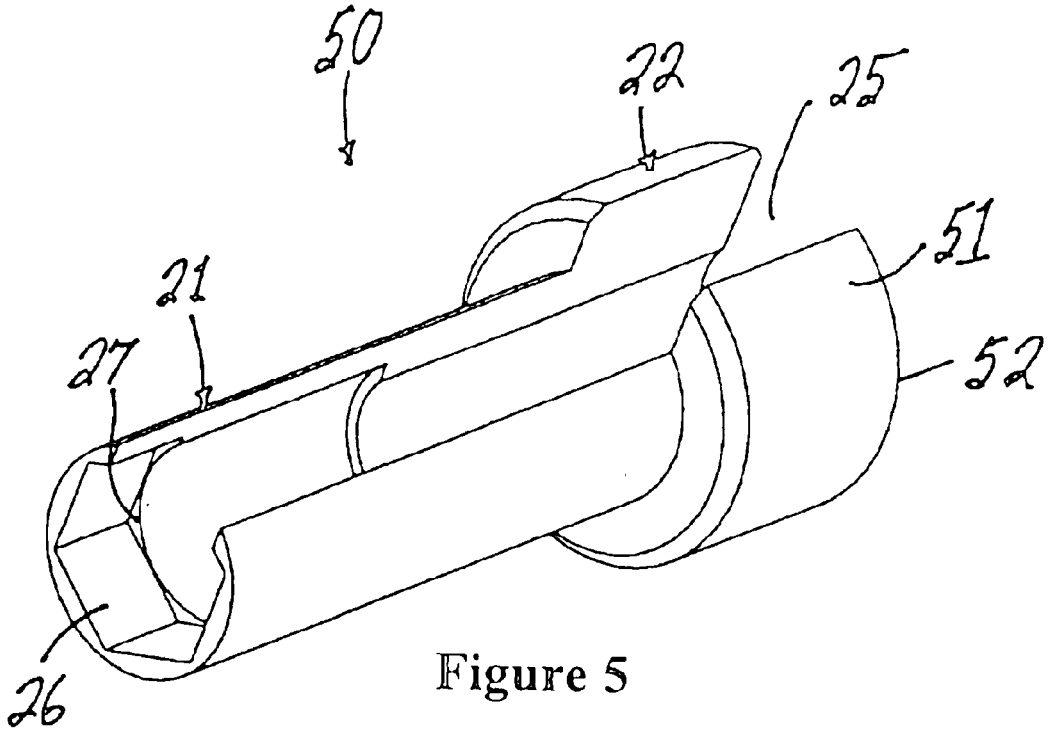
FIG. 5 is a perspective view of a second embodiment of a cable installing tool in accordance with the present invention viewed from the direction of the leading end wherein the grasping portion of the tool comprises a tubular member having an expanded trailing end.
Figure 6:
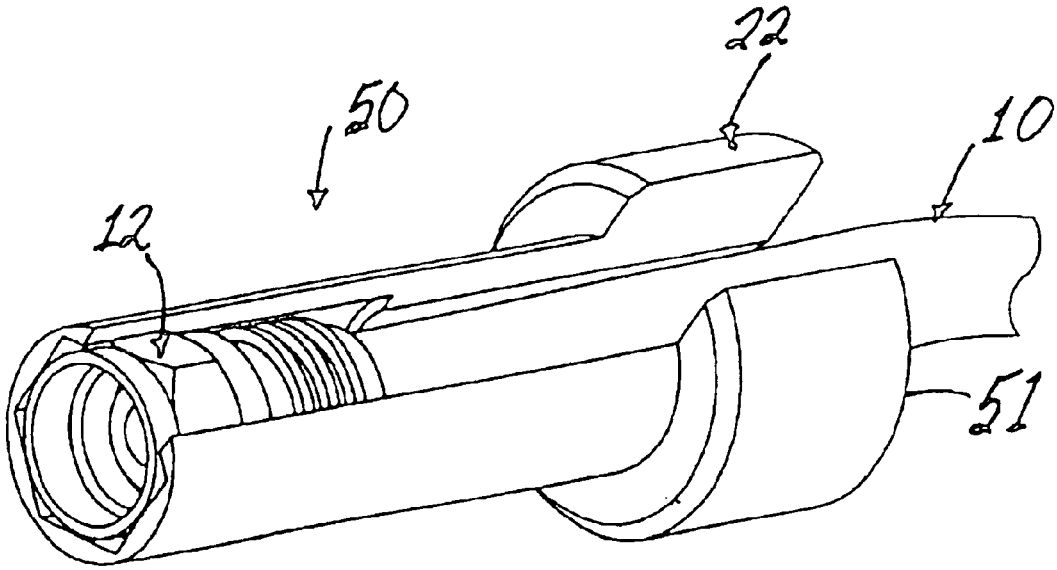
FIG. 6 is a perspective view of the cable installing tool of FIG. 5 showing a male F-type coaxial cable connector disposed within the slotted wrench portion of the tool and the cable extending rearwardly from the grasping portion of the tool in preparation for attaching the cable to a device.

FIG. 5 is a perspective view of a second embodiment 50 of a cable installing tool in accordance with the present invention, viewed from the direction of the leading end, wherein both the wrench portion 21 and the grasping portion 22 of the tool 50 comprises a tubular member, the grasping portion 22 of which has an expanded trailing end 51. The operation of the tool 50 is as described for the first preferred embodiment of the tool indicated at numeral 20 in FIGS. 2 and 3. Again, in operation, the cable is positioned within the axial bore of the tool and extends rearwardly through the trailing end of the grasping portion 22 so as not to interfere with axial rotation of the tool 50. The expanded diameter of the outer surface of the trailing end 51 provides the increased torque necessary to tighten and loosen the connector ring under the conditions presented by a bent cable. FIG. 6 is a perspective view of the cable installing tool 50 of FIG. 5 showing a male F-type coaxial cable connector disposed within the slotted wrench portion of the tool and the cable extending rearwardly from the grasping portion of the tool in preparation for attaching the cable to a device.

Figure 7:
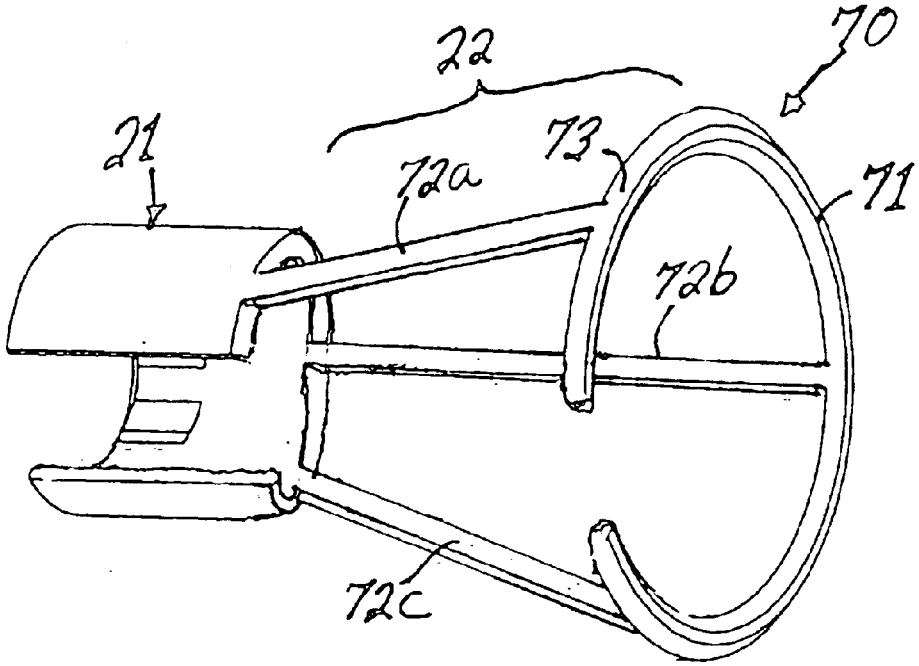
FIG. 7 is a perspective view of a third embodiment of the coaxial cable installing tool wherein the grasping portion comprises an annular ring supported by three rigid struts that are integral with the wrench portion.

FIG. 7 is a perspective view of a third embodiment 70 of the coaxial cable installing tool wherein the grasping portion 22 comprises an annular ring 71 supported by three rigid struts 72*a*, 72*b* and 72*c* that are integral with the wrench portion. The angled struts 72*a*–72*c* support the annular ring 71 and provide high torque means for twisting the wrench portion. The outer surface 73 of the annular ring 71 may be knurled or otherwise textured to prevent the fingers from slipping when torque is applied to the ring 71. The operation of the embodiment 70 of the tool is identical to the operation of the tools 20 and 50 described above. It is obvious to the skilled artisan that although the tool to shows the annular ring being supported by three struts, any number of struts can be used. For example, the embodiment of the tool 20 shown in FIG. 2 is substantially the same as the tool 70, but wherein only a single, sturdy strut is used to support the annular ring.

Figure 8:
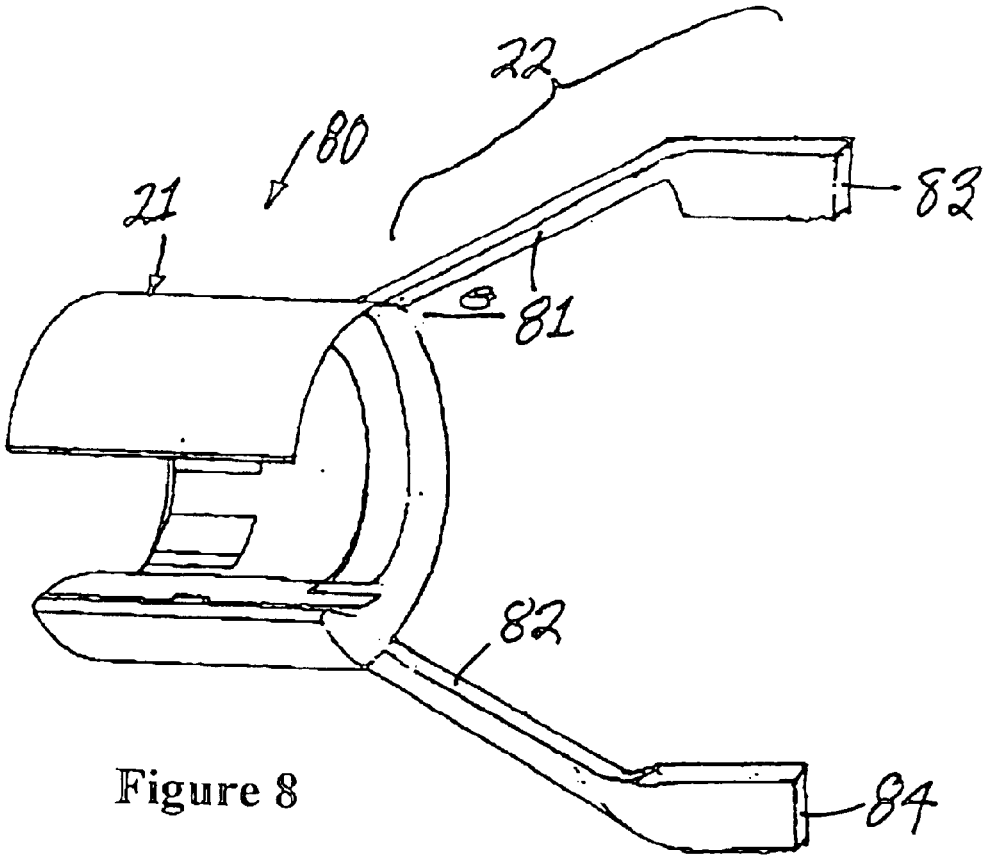
FIG. 8 is a perspective view of a fourth embodiment of the coaxial cable installing tool of the present invention wherein the grasping portion comprises a pair of angled struts that provide high torque means for twisting the wrench portion.

FIG. 8 is a perspective view of a fourth embodiment 80 of the coaxial cable installing tool of the present invention wherein the grasping portion 22 comprises a pair of angled struts that provide high torque means for twisting the wrench portion 21. The trailing ends 83 and 84 of the struts 81 and 82 are preferably flattened or similarly contoured to provide a comfortable surface to receive the fingers of an installer. The increased spacing between the trailing ends 83 and 84 of the struts 81 and 82 relative to the diameter of a connector ring on a male F-type connector enables the user to apply a higher torque to the connector ring than can be applied to the connector ring using only the fingers. The length of the struts should be sufficiently short so as not to extend to nearby cables, and the angle θ should be sufficiently large such that if the bend radius of the cable is three inches or greater, the cable will not interfere with rotation of the tool.

Figure 9:
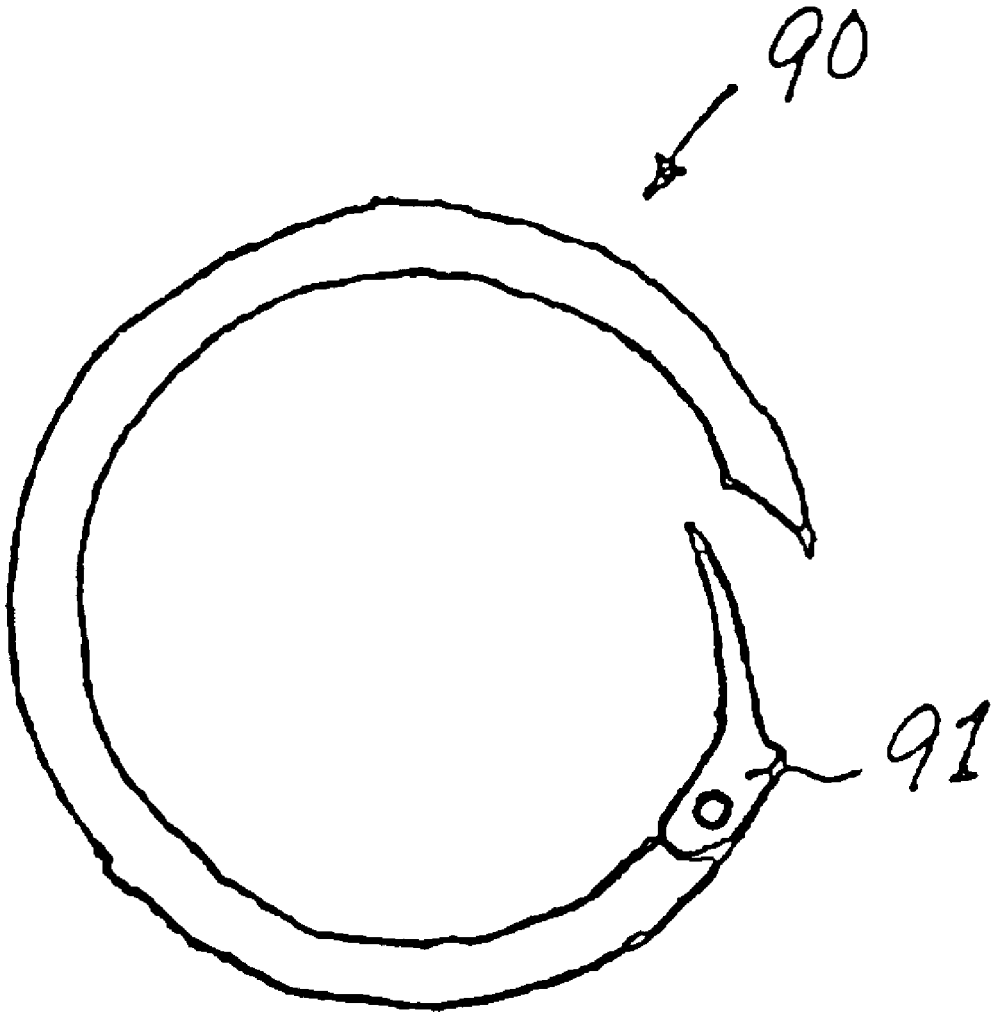
FIG. 9 shows an annular ring suitable for use with the embodiment of the cable installing tool illustrated in FIG. 7 wherein the ring is slotted and has a spring loaded gate permitting passage of the cable through the ring and removal of the tool from the cable following connection of the male F-type connector to a female connector.

FIG. 9 shows an annular ring 90 suitable for use with the embodiment of the cable installing tool 70 illustrated in FIG. 7 wherein the ring is slotted and has a spring loaded gate 91 permitting passage of a cable through the ring and the removal of the tool from the cable following connection of the male F-type connector to a female connector. The spring loaded gate 91 provides a smooth continuous surface around the inner circumference of the ring 90 that permits the ring 90 to be rotated without the (bent) cable impeding the rotation by moving into the slot.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A tool operable for connecting a male F-type coaxial cable connector having a connector ring rotatably mounted on a leading end thereof and a coaxial cable extending rearwardly from a trailing end thereof, to a female F-type connector, the connector ring having a threaded inner surface and a shaped outer surface with a first outer diameter, the tool comprising:

(a) a wrench portion comprising a rigid, substantially tubular member having a leading end, a trailing end and a hollow body portion therebetween, an inner surface of said body portion having an inner diameter substantially equal to said first outer diameter of the connector ring and being shaped to snugly conform to, and matingly engage, a portion of the shaped outer surface of the rotatably mounted connector ring, and a first slot in said body portion extending from said leading end to said trailing end; and (b) a grasping portion comprising a hollow member having an annular leading end having a first outer diameter rigidly affixed to said trailing end of said wrench portion and an expanded annular trailing end having a second outer diameter, said trailing end of said grasping portion being spaced from said leading end of said grasping portion by a rigid spacer therebetween, said annular leading end and said annular trailing end of said grasping portion having a second slot therein and wherein aid second outer diameter of said grasping portion is greater than said inner diameter and wherein said grasping portion has an axial bore coextensive with a length thereof that flares outwardly from said leading end to said trailing end thereof.

2. The tool of claim 1 wherein said rigid spacer comprises a slotted funnel.

3. The tool of claim 1 wherein said rigid spacer comprises an elongate strut.

4. The tool of claim 3 wherein said trailing end of said grasping portion comprises an annular ring.

5. The tool of claim 4 wherein said annular ring has a slot therein.

* * * * *